US005890653A

United States Patent [19]

Kelly

[11] Patent Number: 5,890,653

[45] Date of Patent: Apr. 6, 1999

[54] SENSING AND CONTROL METHODS AND APPARATUS FOR COMMON RAIL INJECTORS

[75] Inventor: William W. Kelly, Granby, Conn.

[73] Assignee: Stanadyne Automotive Corp., Windsor, Conn.

[21] Appl. No.: 65,895

[22] Filed: Apr. 23, 1998

[51] Int. Cl.[6] ..... F02D 1/06; A62C 37/00; B05B 9/00

[52] U.S. Cl. ..... 239/5; 239/75; 239/124; 239/533.8

[58] Field of Search ..... 239/5, 71, 75, 239/124, 127, 533.8, 585.5, 397.5; 123/357, 458, 494, 506

[56] References Cited

U.S. PATENT DOCUMENTS

| | | | |
|---|---|---|---|
| 4,404,944 | 9/1983 | Yamazaki et al. | 123/458 |
| 4,438,496 | 3/1984 | Ohie | 123/458 |
| 4,475,507 | 10/1984 | Miyaki et al. | 123/357 |
| 5,103,792 | 4/1992 | Winkler et al. | 123/506 |
| 5,485,822 | 1/1996 | Hirose et al. | 123/357 |
| 5,697,338 | 12/1997 | Hirose et al. | 123/357 |

*Primary Examiner*—Andres Kashnikow
*Assistant Examiner*—Jorge S. Bocanegra
*Attorney, Agent, or Firm*—Alix, Yale & Ristas, LLP

[57] ABSTRACT

A fuel injector employs at least one sensing device for sensing changes in the thermodynamic properties of the fuel within the injector to thereby monitor injector performance during usage. In some embodiments, advantageously placed temperature sensors are employed to detect the release of thermal energy which occurs when the potential energy of a fuel at high-pressure is suddenly converted into kinetic energy by lowering the pressure of the fuel. Other embodiments of the instant invention employ advantageously placed pressure sensors to detect sudden changes in fuel pressure which occur during the course of the injection cycle. Whereas the sensing devices of the instant invention can be placed at a variety of locations, they are preferably placed to detect changes in the thermodynamic properties of the fuel flowing within an injector where such changes are appreciably large during injector usage. Preferably, injectors of the instant invention are compatible with microprocessor-based fuel-injection control systems to maintain near-ideal injector performance.

23 Claims, 5 Drawing Sheets

SENSING AND CONTROL METHODS AND APPARATUS FOR COMMON RAIL INJECTORS

BACKGROUND OF THE INVENTION (1) Field of the Invention

The present invention generally relates to fuel injection systems for internal combustion engines. More particularly, the invention relates to an improved fuel injector for supplying fuel to an internal combustion engine and methods of controlling the improved fuel injection nozzle. Accordingly, the general objects of the present invention are to provide novel and improved methods and apparatus of such character.

(2) Description of the Related Art

Fuel injection nozzles for supplying fuel to internal combustion engines are well known in the art. Such injectors typically employ an injector body which is affixed to an internal combustion engine such that a nozzle end thereof extends into an engine cylinder. The injector body defines an interior cavity which is fluidly connected with a fuel supply and includes a needle valve which cooperates with the injector body to selectively permit fluid received from the fuel supply to pass through the interior cavity of the injector body and into the engine cylinder. Since most internal combustion engines employ a plurality of cylinders, it is common to employ one or more of such injectors with each engine. Recent developments have focused on supplying fuel to these multiple injectors from a common fuel supply rail which is maintained at very high-pressure, e.g., about 20,000 psi or about 1,380 bars.

One of this type of common rail injector is shown in FIG. 1, during the non-injection phase of the injection cycle. The injector 10 of FIG. 1 employs a hydraulic force imbalance scheme wherein a power piston 12 employs a hydraulic force imbalance scheme wherein a power piston 12 disposed at one end of a needle valve assembly 14 cooperates with other components to control the net system forces acting upon the needle valve 14. In the design shown, a control chamber 16 which lies adjacent one end of the power piston 12 contains a volume of high-pressure fuel during the non-injection phase of the injection cycle. The force of this high-pressure fuel acts downwardly on the power piston 12 to overcome the opposed upward force of the high-pressure fuel acting on annular surface 17 and to thereby urge an opposite end 20 of the needle valve 14 into sealing engagement with apertured nozzle 21 of an injector body 24. In this non-injection phase of operation, the fuel supplied to the injector 10 via inlet 11, is not permitted to pass into the engine cylinder. However, for the injection phase, the pressure within the control chamber 16 can be relieved by energizing a solenoid actuator 33 to move a valve 26 and open a spill path 28 from the control chamber 16 to low-pressure fuel region 52 thereby decreasing the pressure in the control chamber 16. When the pressure within the control chamber 16 drops to a predetermined level, based on the geometry of various injector components, the needle valve 14 moves upwardly to permit fuel to flow through the apertured nozzle 21 of the injector body 24 and into the engine cylinder. De-energizing the solenoid actuator 33 closes the fuel spill path 28. The pressure within the control chamber 16 then increases until it overcomes the upward force acting on the surface 17 and the needle valve 14 is again urged into its initial position. With the fuel injection cycle thus completed, it can be repeated as desired.

Fuel injectors of the type discussed above suffer from a number of deficiencies which tend to limit overall performance. Injector performance can deviate from the ideal due to a wide variety of performance variables and conditions. For example, limitations on manufacturing tolerances can result in the production of injectors which deviate from nominal design specifications. Moreover, changes in fuel viscosity can have a substantial impact on injector performance even in perfectly manufactured injectors. A difference in fuel viscosity can, for example, result from the use of different fuel types and grades. Additionally, ambient environmental conditions such as temperature can cause further fuel viscosity variations. Another factor impacting injector performance characteristics is physical wear and deterioration of injector components occurring over the field-life of the injector. Finally, changes in the electrical characteristics of the actuators employed with such injectors can result in still further deviations from ideal performance. These and other factors all contribute to injector performance characteristics which can deviate measurably from those originally intended.

In order to compensate for such deviations, microprocessor-based fuel injector control systems have been developed. Such control systems more precisely regulate the fuel injection timing and/or quantity by improving the electrical control of electrical actuators used with such injectors. One example of such a control system is described in U.S. Pat. No. 5,103,792 dated Apr. 14, 1992 and entitled "Processor Based Fuel Injection Control System", the contents of which are hereby incorporated by reference. While injection control systems such as those described in U.S. Pat. No. 5,103,792 have resulted in marked improvements in injector performance, further improvements are still possible. In particular, the more directly and rapidly a dedicated sensor can detect the moment at which injection begins (BOI), the more precisely the control system can regulate timing and quantity of the fuel passing through an injector.

SUMMARY OF THE INVENTION

Accordingly, it is an object of the present invention to provide an injector having an improved sensing device to detect injection events.

It is a further object of the present invention to provide an improved fuel injector including a BOI detection sensor for use in a microprocessor-based fuel injection control system.

It is still another object of the present invention to provide an improved fuel injector which utilizes a novel BOI sensing scheme with a fuel injection control system to achieve an optimal combination of injector (1) simplicity; (2) reliability; (3) efficiency; and (4) versatility.

These and other objects and advantages of the present invention are provided in one embodiment by providing a fuel injector of the general nature discussed above which employs at least one sensing device for sensing changes in the thermodynamic properties of the fuel within the injector to thereby monitor injector performance during usage. In some embodiments, advantageously placed temperature sensors are employed to detect the release of thermal energy which occurs when the potential energy of fuel at high-pressure is suddenly converted into kinetic energy by lowering the pressure of the fuel. Other embodiments of the instant invention employ advantageously placed pressure sensors to detect sudden changes in fuel pressure which occur during the course of the injection cycle. Whereas the sensing devices of the instant invention can be placed at a variety of locations, they are advantageously arranged to detect the thermodynamic properties of the fuel flowing within an injector where the changes in such properties are appreciably large during injector usage. Preferably, injectors of the instant invention are compatible with microprocessor-based fuel injection control systems of the type described above to maintain near-ideal control over the injector.

Numerous other advantages and features of the present invention will become apparent to those of ordinary skill in the art from the following detailed description of the invention, from the claims and from the accompanying drawings.

BRIEF DESCRIPTION OF THE DRAWINGS

The preferred embodiments of the present invention will be described below with reference to the accompanying drawings wherein like numerals represent like structures and wherein.

DESCRIPTION OF THE PREFERRED EMBODIMENTS

A first preferred embodiment of the injector according to the invention will be described primarily with joint reference to FIGS. 2*a* and 2*b*. Those of ordinary skill in the art will readily appreciate that the injector 10' of FIGS. 2*a* and 2*b* incorporates the present invention into an electrically controlled common-rail type fuel injector for use with a diesel engine. However, it will also be appreciated that the instant invention can be incorporated into a variety of other styles of known fuel injectors which are controlled by rapid fluid flow changes induced as part of the control event.

Figure 1:
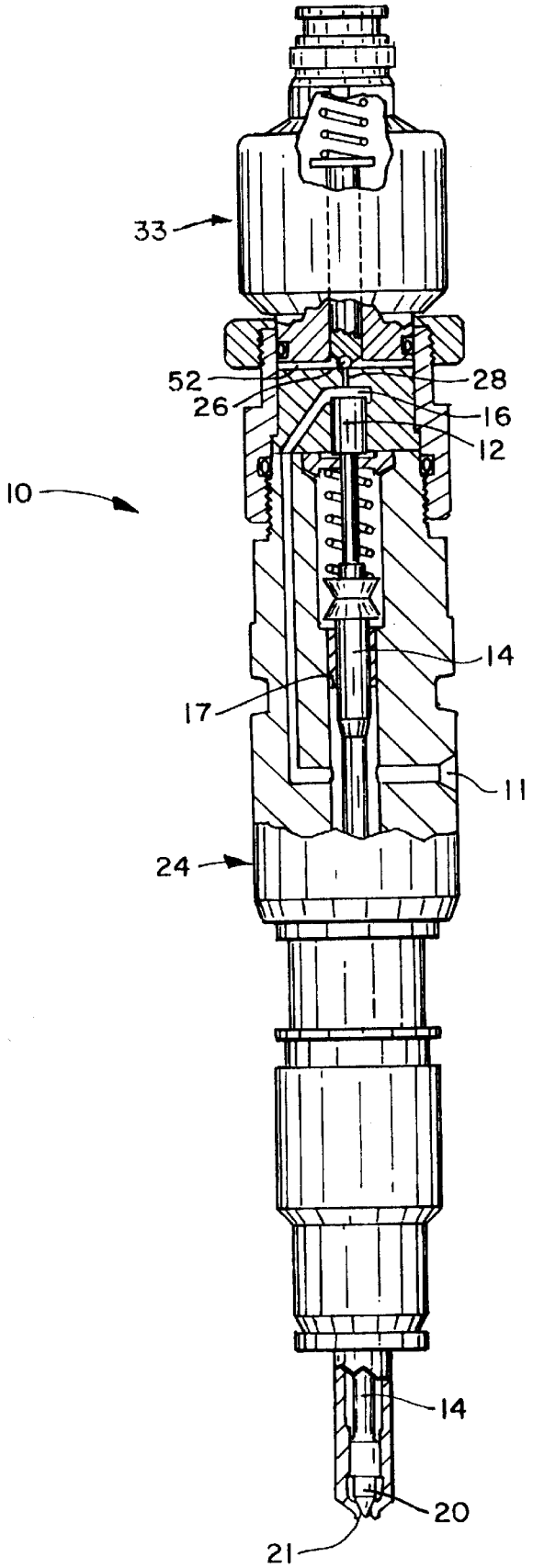
FIG. 1 PRIOR ART
FIG. 1 is a cross-sectional elevation view of a common rail injector of the related art.
Figure 2B:
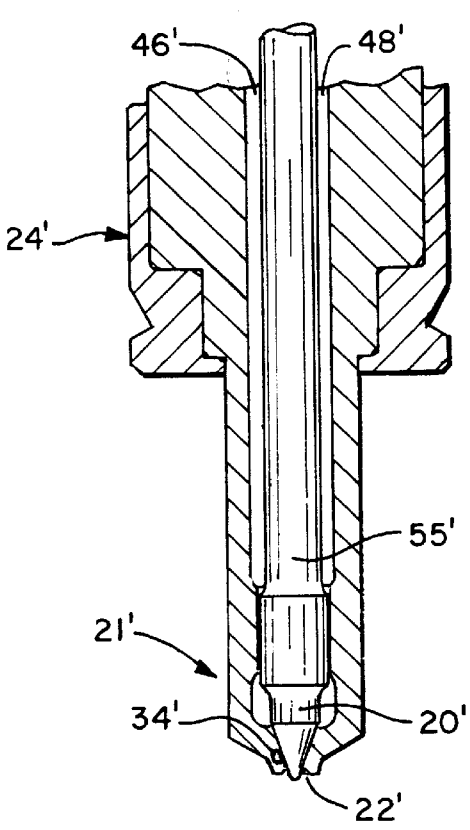
FIG. 2*b* is a cross-sectional elevation view of another portion of the common rail injector partially depicted in FIG. 2*a,* FIG. 2*b* being partially schematic.
Figure 2A:
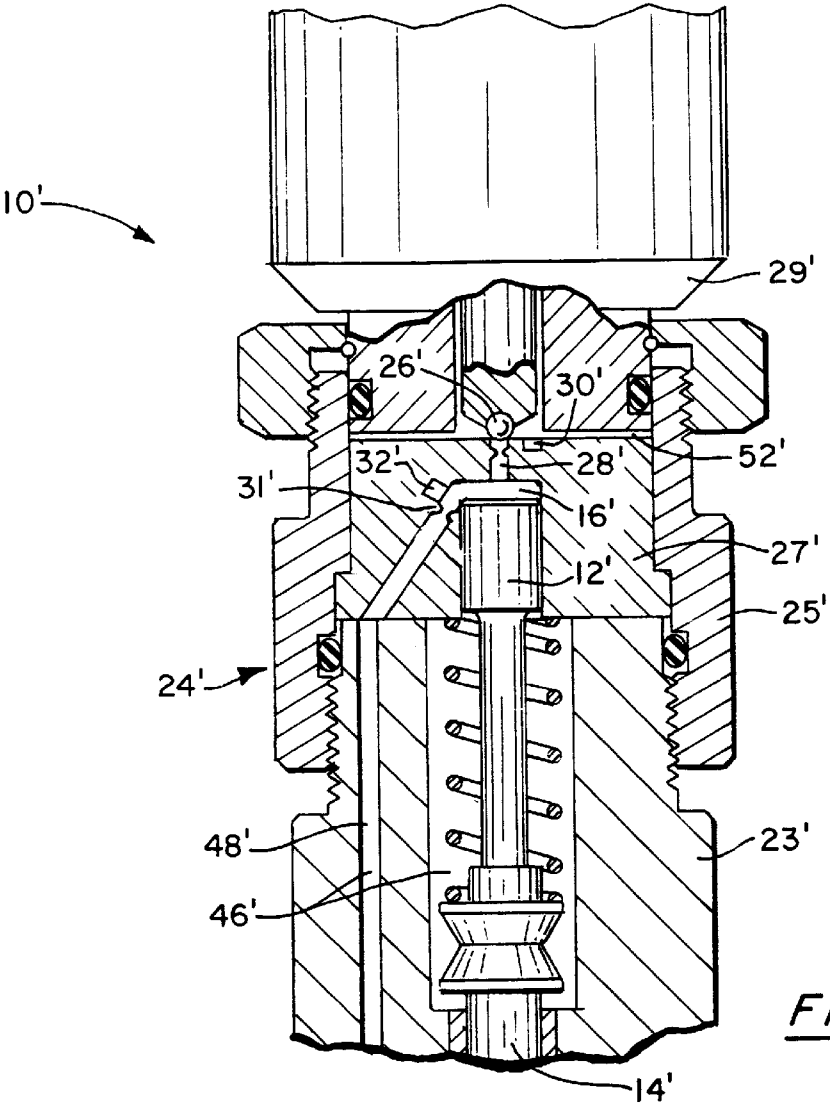
FIG. 2*a* is a cross-sectional elevation view of a portion of one embodiment of the common rail injector of the present invention, FIG. 2*a* being partially schematic.

The injector 10' of FIGS. 2*a* and 2*b* includes an injector body 24' which is comprised of a plurality of assembled components 23', 25', 27' and 29'. Injector body 24' can be installed into an internal combustion engine (not shown) with the apertured injector nozzle 21' disposed within the engine cylinder. The internal combustion engine with which the instant invention is used preferably includes an associated high-pressure fuel supply 13 (see FIG. 3) which delivers fuel at approximately 20,000 psi, or about 1,380 bars, to the injector 10' and an associated low-pressure fuel return 15 (see FIG. 3) which removes low-pressure fuel from injector 10'. The high-pressure fuel supply 13 is preferably connected to a high-pressure fuel conduit region 48' of an interior cavity 46', defined within injector body 24'. The interior cavity 46' also includes a control chamber region 16' and a low-pressure fuel return region 52' extending therefrom. At least one nozzle aperture 22' extends through the injector body 24' in nozzle region 21' and into the interior cavity 46' to permit fluid communication therebetween.

The injector 10' further comprises a movable needle valve assembly 14' disposed within the interior cavity 46' for movement between fuel-blocking and fuel-injection positions. The needle assembly 14' preferably includes a first end 55' which is capable of sealingly engaging the injector body 24' to block fuel passage through nozzle aperture 22' when the needle valve 14' is in the fuel-blocking position. It will be readily appreciated that needle valve 14' can be shaped in a wide variety of ways to sealingly engage injector body 24' to restrict the flow of fuel through the interior cavity 46' as desired. A second end of the movable needle valve 14' preferably comprises a control, or power, piston 12' which sealingly engages injector body 24' to define the variable-volume control chamber 16' therebetween. As can be seen from FIG. 2*a,* control chamber 16' is preferably connected with high-pressure region 48' via a flow restricting inlet orifice 31'. Similarly, control chamber 16' is connected to low-pressure fuel region 52' via a flow restricting outlet orifice 28'. Since the fluid flow paths immediately downstream of the inlet and outlet orifices rapidly increase in cross-sectional area, fuel flowing therethrough naturally decreases in pressure.

In the injector 10' of FIGS. 2*a* and 2*b,* injection events are controlled by opening and closing ball valve 26'. Thus, when ball valve 26' is closed, high-pressure fuel is permitted only in high-pressure fuel region 48', inlet orifice 31', control chamber 16' and outlet orifice 28'. The pressure of these regions is, thus, maintained at a fixed high value. The force of this pressure, in turn, drives needle valve assembly 14' into the fuel-blocking position. Actuator valve 26' is opened at the beginning of the fuel-injection phase of the injection cycle. This permits the high-pressure fuel to pass into low-pressure fuel region 52' which, in turn, reduces the pressure acting on the control piston 12' and increases the fuel pressure within the low-pressure fuel region 52' in the immediate vicinity of outlet orifice 28'. This change in pressure shifts the force balance acting on the needle valve 14' so that needle valve 14' moves upwardly into the fuel-injection position. As the high-pressure fuel enters low-pressure fuel region 52', it is accelerated due to the pressure difference between high-pressure regions 48', 31', 16' and 28' and low-pressure region 52'. This fuel-flow causes the potential energy of the high-pressure fuel to be converted into kinetic energy and generates heat which increases the temperature of the fuel within the low-pressure region 52'. Upon closing ball valve 26', the high-pressure fuel is, again, prevented from entering low-pressure return 52'. This results in an immediate drop in the fuel pressure and temperature within low-pressure fuel region 52' and a temperature drop and a pressure increase in the control chamber. Consequently, the needle valve assembly 14' will also return to the fuel-blocking position described above.

Opening and closing ball valve 26 will also result in similar thermodynamic effects on the fuel flowing through other portions of the injector 10'. For example, opening ball valve 26' will cause a temperature increase and a pressure decrease in the fuel at (i.e., within, and in the immediate vicinity of) inlet orifice 31'. Similarly, closing ball valve 26' will cause a temperature decrease and a pressure increase in the fuel at (i.e., within, and in the immediate vicinity of) inlet orifice 31'.

Temperature and pressure changes also occur in the fuel flowing through nozzle region 21' shown in FIG. 2*b*. For example, when ball valve 26' is opened, and needle valve assembly 14' moves into the fuel-injection position and the flow of fuel through region 21' causes a temperature and a pressure increase in the fuel disposed therein. Closing ball valve 26' causes needle valve assembly 14' to move into the fuel-blocking position and temperature and pressure decreases occur in the fuel disposed in region 21'.

In one embodiment of the instant invention, a fast-acting thermal sensor 30' (FIG. 2*a*) is placed just downstream of valve 26' and used to monitor the temperature of the fuel within low-pressure fuel region 52'. Sensor 30' is preferably a rapid response thermocouple. Due to the low mass and rapid response rate of such a sensor, it is ideally suited for use with the instant invention. Regardless of the particular thermal sensor used, however, the thermal sensor detects the fuel temperature changes within the low-pressure fuel region 52' as discussed above. Further, since injection events necessarily entail concomitant changes in the position of needle valve 14' and the temperature of fuel flowing into low-pressure fuel region 52', temperature changes detected by thermal sensor 30' can be used to determine the flow of fuel into the engine cylinder. Thus, fuel-flow signals which are generated by the sensors and commensurate with fuel-flow in injector 10' can then be sent to an electronic control unit 19, e.g., a microprocessor, of a control system associated with the engine (See FIG. 3). The control system can then use the fuel flow signal to modify the phasing and duration of injection events by comparing the actual injector performance with the desired injector performance and sending error correction signals to solenoid 30' as necessary.

In an alternative embodiment, a thermal sensor 32', (FIG. 2*a*) for detecting the temperature of the fuel flowing within injector 10', is positioned within inlet orifice 31', the inlet orifice 31' being located between the high-pressure fuel region 48' and the control region 16'. Thermal sensor 32' detects the flow of fuel through injector 10' in substantially the same manner as thermal sensor 30' except that thermal sensor 32' is responsive to thermodynamic conditions caused by fuel flow into the control chamber 16' through inlet orifice 31'. As with sensor 30', sensor 32' is preferably a rapid response thermocouple. As can best be seen in FIG. 2*a,* the cross-sectional area of the fuel restricting inlet orifice 31' is much smaller than the cross-sectional area of the downstream control region. This arrangement creates a reduction in the pressure of fuel passing through inlet orifice 31' and into control region 16'. Naturally, the signals generated by sensor 32' are also intended to be transmitted to an electronic control unit 19 of an injection control system to modify the phasing and duration of injection events as necessary in the manner described above.

Figure 3:
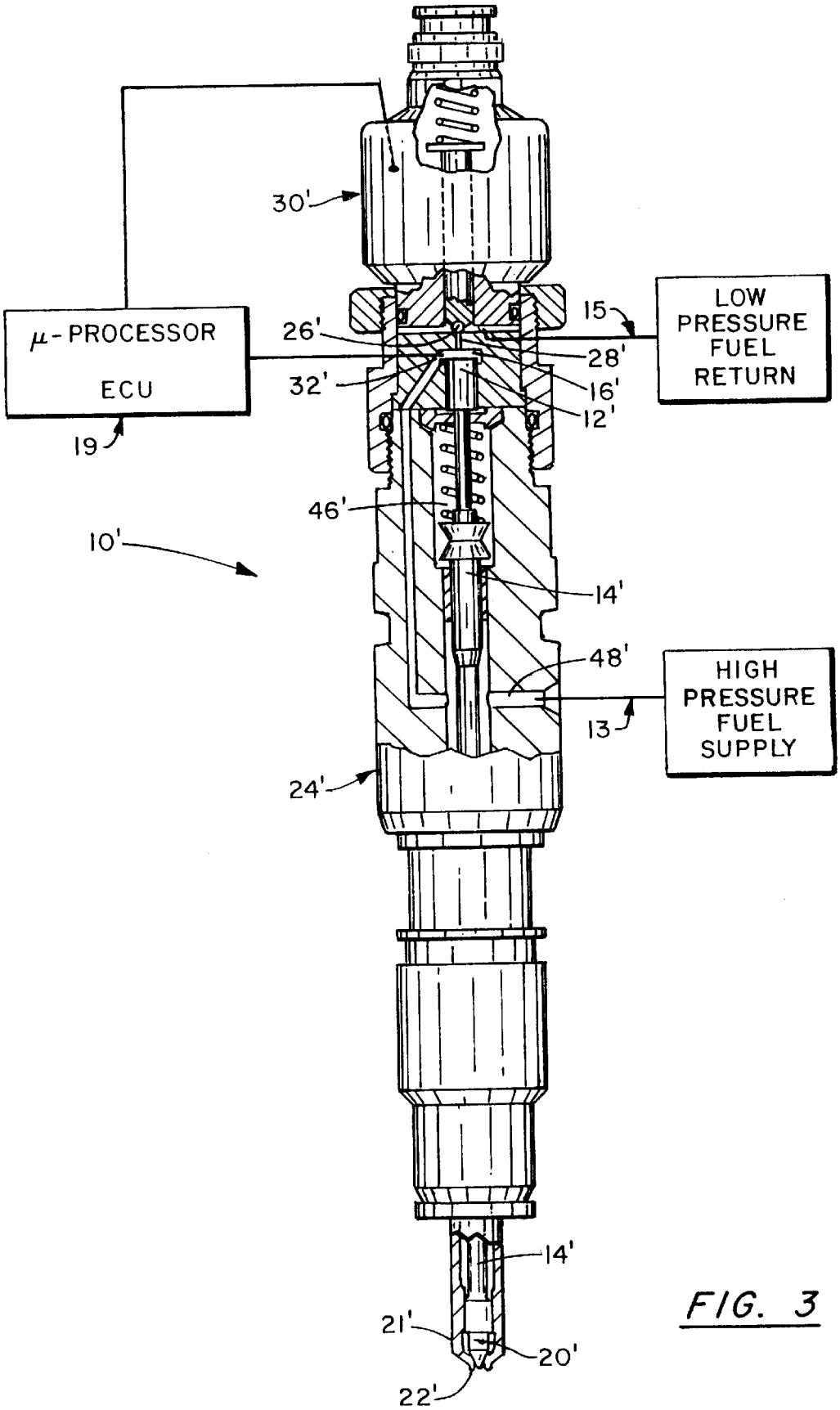
FIG. 3 is a cross-sectional elevation view of the common rail injector of the present invention shown in conjunction with a closed loop control system, FIG. 3 being partially schematic.
Figure 4:
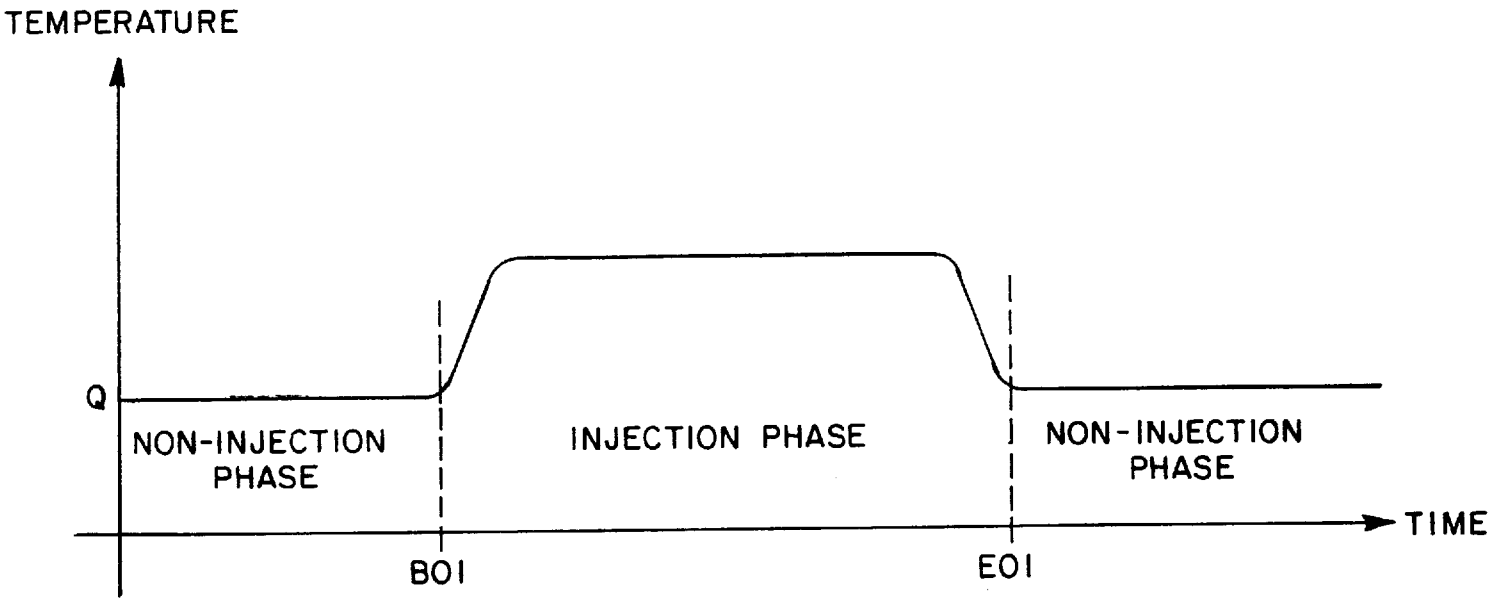
FIG. 4 is a diagram illustrating the fuel-flow signal generated by the sensor of the FIG. 3 injector over the course of one injection cycle.

The fuel flow signal generated by sensor 32' of the FIG. 3 injector is illustrated in FIG. 4 over the course of one injection cycle. As shown therein the fuel flow signal indicates that the temperature of the fuel at inlet orifice 31' remains fairly stable at a quiescent value Q during the non-injection phase of the injection cycle. When injector 10' enters the injection phase of the injection cycle due to the flow of fuel through inlet orifice 31', control chamber 16' and into low-pressure fuel region 52' the fuel flow signal indicates that the temperature of the fuel at inlet orifice 31' increases rapidly. Similarly, at the end of the injection phase the fuel flow signal reflects the rapid decrease in the (now non-flowing) fuel at the inlet orifice. Naturally, both the methods and apparatus for processing the signal of FIG. 4 are well known in the art and need not be further described here. Also, those of ordinary skill will readily appreciate that the fuel flow signals generated by sensors 30', 32', and 34' can be used to determine both the beginning BOI and end EOI of the injection events as desired.

In still another alternative embodiment of the instant invention, a thermal sensor 34' (FIG. 2*b*) is located between the needle valve shoulder seat 20' and the nozzle aperture 22'. In this location, sensor 34' can effectively sense injection events of injector 10' due to fuel flow through nozzle aperture 22' based upon the flow of fuel therethrough and the thermodynamic principles noted above. Thus, the thermal sensor 34' will provide a fuel-flow signal which is commensurate with the flow of fuel through nozzle aperture 22'. Sensor 34' is preferably a heat flux sensor but could, alternatively, be any of the aforementioned sensor types. While it is believed exceptional results could be achieved by using sensor 34' as indicated, in practice the utility of utilizing thermal sensor 34' in the location shown is limited due to the large mechanical and fluid loading to which sensor 34' is subjected to during operation of injector 10'.

Figure 5:
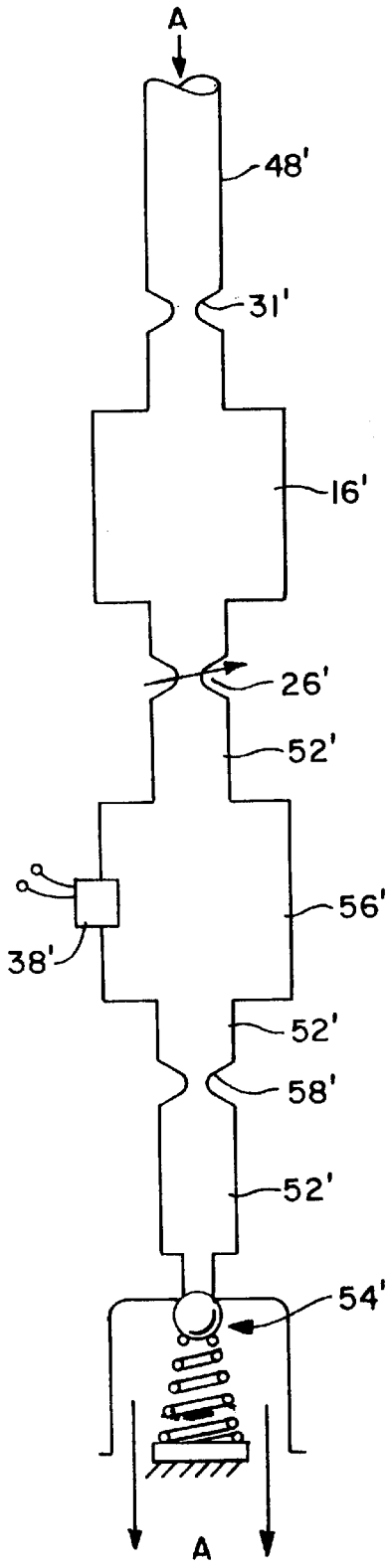
FIG. 5 is a schematic representation illustrating another embodiment of the instant invention.

A further embodiment of the instant invention is schematically represented in FIG. 5. Those of ordinary skill will readily appreciate that the drawing of FIG. 5 only schematically represents a portion of the injector of this embodiment, the remainder of the injector being substantially similar to those illustrated in FIGS. 2*a,* 2*b* and 3. Accordingly, high-pressure fuel region 48', inlet orifice 31', control chamber 16', ball valve 26' and low-pressure fuel region 52' of FIG. 5 all correspond to the like-numbered components of FIGS. 2*a,* 2*b* and 3. As with the earlier embodiments, selective operation of ball valve 26' determines the pressure and volume of fuel contained within control chamber region 16' which, in turn, determines the position of needle valve assembly 14' (not depicted in FIG. 5).

The embodiment of FIG. 5 also includes a number of features not utilized in the earlier described embodiments of the instant invention. For example, the embodiment of FIG. 5 includes a back-pressure device 54' which produces a back-pressure within low-pressure fuel region 52'. Additionally, a pressure sensing chamber 56' is disposed in fluid communication with and along the length of low-pressure fuel region 52'. Also, a fuel flow restriction device 58' is interposed downstream (i.e., in the direction of arrow A) of pressure-sensing chamber 56'. The back-pressure device 54' and flow restriction 58' are sized and shaped to create quiescent back pressure within pressure sensing chamber 56' which can be detected by a pressure sensor 38' disposed within chamber 56'. However, the quiescent back pressure is still low enough to keep the overall pressure level within chamber 56' relatively low so that an inexpensive pressure sensor 38' can be employed. As shown, pressure sensor 38' is disposed within pressure sensing chamber 56' for measuring the pressure therein. Alternatively, direct thermal measurement devices could be utilized with this embodiment of the present invention. Regardless of the sensor used, however, those of ordinary skill will recognize that pressure sensor 38' detects pressure changes within sensing chamber 56' due to the flow of fuel therethrough upon opening and closing of ball valve 26' as described above. The back pressure device 54' serves to precondition all of the low-pressure cavities to a known pressure to eliminate therefrom gaseous air and vapor and to thereby improve the accuracy of the pressure readings.

As with the embodiments described above, the embodiment of FIG. 5 can be used as a feedback measurement for a fuel injection control system of the type noted above to control the flow of fuel through a fuel injector and into an engine cylinder. Naturally, the position, shape and size of the various components schematically represented in FIG. 5 can be varied to optimize their interaction with one another.

Many variations of the present invention are possible. For example, the sensor locations of FIGS. 2*a,* 2*b,* 3 and 5 can be altered to some extent without severe degradation in sensing capability. However, it should be noted that the locations indicated are the preferred locations because the fuel pressure and temperature differentials occurring during each injection cycle are maximized at these locations. Additionally, one or more of the thermal sensors of FIGS. 2*a* and 2*b* can be utilized in combination to produce multiple sensor signals. Further, any one or more of these can be combined with the pressure sensor of FIG. 5 to produce yet another sensor signal. Naturally, and as noted above, the principles of the present invention discussed herein are readily adaptable to a wide variety of well-known and commonly used types of fuel injectors. Similarly, the principles of the present invention discussed herein are readily adaptable to a variety of known and commonly used types of fuel injection control systems.

While the present invention has been described in connection with what is presently considered to be the most practical and preferred embodiments, it is to be understood that the present invention is not limited to the disclosed embodiments. Rather, it is intended to cover all of the various modifications and equivalent arrangements included within the spirit and scope of the appended claims.

What is claimed is:

1. A fuel injector of the type used to inject fuel into a cylinder of an internal combustion engine when installed therein, the engine having a high-pressure fuel supply which delivers fuel to said injector and a low-pressure fuel return which removes fuel from said injector, said injector comprising:

an injector body which defines an interior cavity, said interior cavity including a variable-volume control region, a high-pressure fuel region fluidly connected with the high-pressure fuel supply, an apertured nozzle region fluidly connected with the engine cylinder when said injector is installed in the engine, and a low-pressure fuel region fluidly connected with the low-pressure fuel return;

a needle valve assembly at least partially disposed within said injector for movement between first and second positions, said needle having an injection portion which blocks fuel flow through said nozzle region when said needle is in said first position, said injection portion of said needle permitting fuel flow through said nozzle region when said needle is in said second position;

valve means for selectively permitting fluid flow between said control region and said low-pressure fuel region to thereby vary the volume of said control region and urge said needle assembly between said first and second positions; and sensor means for sensing changes in the thermodynamic properties of the fuel within said injector when said needle assembly moves between said first position and said second position.

2. The injector of claim 1, wherein a flow restricting inlet orifice fluidly connects said high-pressure fuel region with said control region, wherein said sensor means comprises a temperature sensor which is disposed at said inlet orifice, and wherein said inlet orifice cooperates with said control region to reduce the pressure of the fuel entering said control region via said inlet orifice.

3. The injector of claim 2, wherein said sensor is in fluid contact with the fuel at said inlet orifice.

4. The injector of claim 1, wherein said sensor means is at least partially disposed within said low-pressure fuel region and generally adjacent said control region, and wherein said sensor means senses the temperature of the fuel within said low-pressure region.

5. The injector of claim 1, wherein said sensor means is disposed immediately adjacent said control region.

6. The injector of claim 1, wherein said nozzle region includes an injection aperture extending through said injector body and into the engine cylinder, said body further comprises a shoulder seat at one end of said nozzle region, said needle sealingly engages said shoulder seat when said needle is in said first position, said sensor means is disposed between said shoulder seat and said injection aperture, and said sensor means senses the temperature of the fuel within said nozzle region.

7. The injector of claim 1, wherein said injector further comprises back pressure means for presenting back pressure within said low-pressure fuel region and restriction means for restricting fuel flow through said low-pressure fuel region, said restriction means being disposed between said back pressure means and said valve means, wherein said sensor means is at least partially disposed within said low-pressure fuel region between said back pressure means and said restriction means, and wherein said sensor means senses the pressure of the fuel within said low-pressure fuel region.

8. The injector of claim 7, wherein said low-pressure fuel region further comprises a fuel-pressure sensing chamber fluidly connected between said valve means and said restriction means, wherein said sensor means is at least partially disposed within said sensing chamber and wherein said sensor means senses the pressure of the fuel within said sensing chamber.

9. The injector of claim 8, wherein said sensing chamber is adjacent said valve means.

10. The injection of claim 1, wherein said injector further comprises restriction means for restricting fuel flow through said low-pressure fuel region, said low-pressure fuel region further comprises a fuel-pressure sensing chamber disposed between said valve means and said restriction means, and said sensor means is at least partially disposed within said sensing chamber for sensing the pressure of the fuel within said sensing chamber.

11. The injector of claim 10, wherein said sensing chamber is adjacent said valve means.

12. A method of controlling a fuel injector of the type used to inject fuel into a cylinder of an internal combustion engine when the injector is installed therein, the engine having a high-pressure fuel supply which delivers fuel to the injector, a low-pressure return which removes fuel from the injector and an electronic control unit for sending, receiving and processing control signals related to injector operation, the injector having a variable-volume control chamber in selective fluid communication with the high-pressure fuel supply and the low-pressure fuel return, the injector also having a needle valve assembly disposed within the injector for movement between an injection-blocking position wherein fuel is not permitted to flow from the high-pressure fuel supply into the engine cylinder, and an injection-permitting position wherein fuel is permitted to flow from the high-pressure fuel supply into the engine cylinder, the needle movement being dependent on the fuel flow through the control chamber, the injector also having a valve for selectively establishing fluid communication between the control chamber and at least one of the high-pressure fuel supply and the low-pressure fuel return, said method comprising the steps of:

sending an injector control signal to the injector from the electronic control unit;

sensing at least one thermodynamic property of the fuel within at least one portion of the injector to produce a fuel flow signal commensurate with fuel-flow at the one portion;

transmitting the fuel-flow signal to the electronic control unit;

receiving the fuel-flow signal at the electronic control unit;

comparing the injector control signal with the fuel-flow signal; and sending an error correction signal to the injector if the injector control signal differs from the fuel-flow signal by more than a predetermined amount.

13. The method of claim 12, wherein said step of sensing comprises sensing a change in the temperature of the fuel flowing through the injector to produce a fuel-flow signal commensurate with the fuel-flow through the control chamber.

14. The method of claim 12, wherein said step of sensing comprises sensing a change in the pressure of the fuel flowing through the injector to produce a fuel-flow signal commensurate with the fuel-flow into the low-pressure return.

15. The method of claim 12, wherein said step of sensing comprises sensing a change in the temperature of fuel flowing through the injector and into the engine cylinder to produce a fuel-flow signal commensurate with the fuel-flow into the engine cylinder.

16. The method of claim 12, wherein said step of sensing comprises sensing a change in the temperature of the fuel flowing into the low-pressure return to produce a fuel-flow signal commensurate with the fuel-flow into the low-pressure return.

17. A fuel injector of the type used to inject fuel into a cylinder of an internal combustion engine when installed therein, the engine having a high-pressure fuel supply which delivers fuel to said injector and a low-pressure fuel return which removes fuel from said injector, said injector comprising:

an injector body which defines an interior cavity, said interior cavity including a variable-volume control region, a high-pressure fuel region fluidly connected with the high-pressure fuel supply, an apertured nozzle region fluidly connected between the high-pressure fuel supply and the engine cylinder when said injector is installed in the engine, and a low-pressure fuel region fluidly connected between said control region and the low-pressure fuel return;

a needle valve assembly at least partially disposed within said injector for movement between first and second positions, said needle having an injection portion which is capable of blocking fuel flow into the engine cylinder when said needle is in said first position;

valve means for selectively interrupting fluid communication between said control region and said low-pressure return, said valve means being disposed for movement between an initial position, wherein said control region is not in fluid communication with said low-pressure return whereby said needle is urged into said first position, and an injection position, wherein said control region is in fluid communication with said low-pressure return whereby said needle is urged into said second position; and means for sensing movement of said needle valve between said first and second positions due to fuel-flow through said injector.

18. The injector of claim 17, wherein said injector further comprises a flow restricting inlet orifice fluidly connecting said high-pressure fuel region and said control region, and said means for sensing comprises a temperature sensor which is disposed at said inlet orifice for sensing the temperature of the fuel within said inlet orifice.

19. The injector of claim 17, wherein said means for sensing is in fluid contact with the fuel at said inlet orifice.

20. The injector of claim 17, wherein said injector further comprises a control region outlet orifice fluidly connecting said low-pressure fuel region and said control region, said means for sensing comprises a temperature sensor disposed at least generally adjacent said outlet orifice, and said temperature sensor senses the temperature of the fuel within said outlet orifice.

21. The injector of claim 20, wherein said means for sensing is in fluid contact with the fuel at said outlet orifice.

22. The injector of claim 20, wherein said means for sensing is in fluid contact with the fuel at said low-pressure return.

23. The injector of claim 17, wherein said nozzle region includes an injection aperture extending through said injector body and into the engine cylinder, said body further comprises a shoulder at one end of said nozzle region, said needle sealingly engages said shoulder when said needle is in said first position, said means for sensing is disposed between said shoulder and said injection aperture, and said sensor means senses the temperature of the fuel within said nozzle region.

* * * * *